United States Patent [19]

Lane et al.

[11] 4,105,141

[45] Aug. 8, 1978

[54] POURING DEVICE

[75] Inventors: Charles Anthony Lane, Richmond; Anthony James Lucking, London, both of England

[73] Assignee: Waddington & Duval (Holdings) Limited, London, England

[21] Appl. No.: 749,016

[22] Filed: Dec. 9, 1976

[51] Int. Cl.[2] ..... B67D 3/00

[52] U.S. Cl. ..... 222/143; 222/153; 222/479; 222/488; 222/563

[58] Field of Search ..... 222/143, 153, 479, 482, 222/488, 478, 563

[56] References Cited

U.S. PATENT DOCUMENTS

| | | | |
|---|---|---|---|
| 1,607,774 | 11/1926 | Morse | 222/143 |
| 3,268,125 | 8/1966 | Waldrum | 222/482 |
| 3,330,450 | 7/1967 | Clare | 222/479 |
| 3,776,434 | 12/1973 | Christensen et al. | 222/563 X |

*Primary Examiner*—Robert B. Reeves
*Assistant Examiner*—John P. Shannon
*Attorney, Agent, or Firm*—Wood, Herron & Evans

[57] ABSTRACT

A pouring device for use with a container, the device having a central liquid outlet and air inlets positioned annularly around the outlet so that whatever the axial alignment of the device when fitted to the container there is always an air inlet above the outlet; the device has a flared pouring lip which extends to a planar annular lip; preferably a bung is provided to close the outlet and inlets which may be attached to the lip of the device by means of a break away ring provided on the planar portion of the lip of the device.

5 Claims, 3 Drawing Figures

POURING DEVICE

This invention relates to a pouring device for use in the top of a container which can be stacked on a similar container, the device aiding the dispensing of the liquid contents of the container.

In order to obtain good pouring characteristics ensuring that the liquid clears the upper rim or chime of the container, various extending lips have been proposed such as may be seen in U.S. Pat. No. 1,607,774 (A.A. Morse). In this patent the pouring device has an upward and outward standing lip which has to be detached from a sunken central stowage position on the container where it does not foul the container above to an outer pouring position where it can be effectively used. Such a device is cumbersome in use and due to the unidirectional lip arrangement must be carefully fitted during assembly.

Multi directional lips have also been proposed such as may be seen in French Pat. No. 1,599,455 (J. Ferrer), which overcome the problem of axial alignment in fitting, but the construction of the device shown in this patent is such that in order to obtain a good pouring characteristic a central pouring tube has been extended above the lip of the pourer. Such an arrangement necessitates the pourer to be fitted in a sunken area in the container if one container is to be stacked on another, and also the pouring area is removed to a considerable distance from the edge of the container.

An object of the invention is therefore to provide a pouring device having a central pouring tube which is positined with its outlet below a pouring lip which extends in a widely flared manner away from the pouring tube.

A further problem is to provide a suitable bung for the pourer since this is liable to increase the height of the pouring device.

Accordingly a further object is to form the pouring lip as a thin planar annulus onto which the bung having a corresponding peripheral thin planar annulus can abut and the sealing surface of the bung is provided at a level lower than the annulus of the bung.

The pouring device in accordance with the invention has an air inlet positioned annularly around the pouring tube to ensure good pouring characteristics. As the air inlet completely around the outlet there is no need to align the inlet relative to the container with which the pourer is to be used.

A further problem which the applicant endeavored to solve was that of effectively and securely mounting the device in a simple hole in the upper wall of the container. For good diametrical tightness in the hole in the container a bung should be provided with a peripheral groove which locks into the hole. The problem is how to exert a sufficient axial force on the device during assembly without distoring the device which is suitably made of a plastics material.

Thus according to the preferred embodiment the device is provided with a body having substantially cylindrical wall in which is an outer peripheral container engaging groove, the body extending outward conically from an area adjacent the groove to a thin planar annulus forming a pouring lip, wherein an annular rim is provided in said area adjacent the groove at the root of the conical extension on the interior of the body, and wherein a bung is provided whose interior and exterior surface approximately conforms to the interior shape of the body of the device, from the interior rim outwardly along the conical extension and at least covering a part of the annular lip, the bung having a sealing surface below said annular rim, wereby that outer part of the bung coinciding with said interior annular rim forms a surface which can be engaged by a mandrel to securely force the bung into a hole in a container so that said engaging groove seats in said hole.

An advantage of the annular pouring lip is that it provides a convenient surface onto which the bung may be secured by means of a break away ring on this surface. The ring is thus positioned in a very evident location for inspection to see if it has been broken prior to sale of the container.

The provision of a thin annular lip enables the lip to be extended when fitted in a container even over the upper chime of the container without effectively reducing the ability to stack one container on another. In the event of extending the lip over or radially beyond the chime the pouring characteristics can be further improved.

The invention also extends to the combination of a container having a pourer in accordance with the invention inserted in the surface of the container and partially encompassed by a chime which is approximately half the height by which the pouring device and bung extend from the surface into which the pourer in inserted. The opposed end of the container preferably has a similarly dimensioned chime so that one container may be stacked upon another with the pouring device located between the two containers without impairing the stability of the stack of containers.

The invention will now be further described by way of example with reference to the accompanying drawings, in which.

Figure 1:
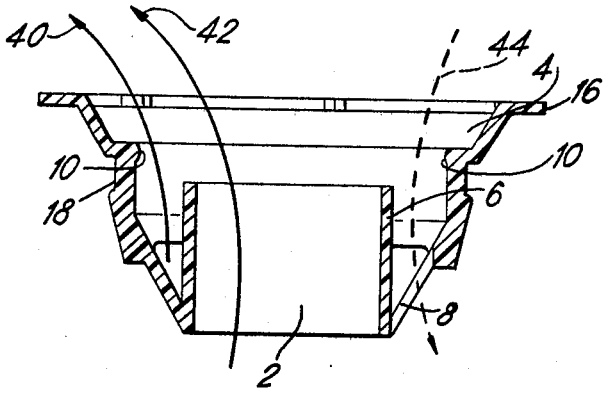
FIG. 1 is a cross-section of a pouring device in accordance with the invention.

The pourer shown in the drawings incorporates a central liquid outlet 2 and an annular air inlet generally indicated at 4 which extends around the tubular body 6 of the liquid outlet. The air inlet 4 communicates with a number of orifices 8 extending annularly around the liquid outlet and passing through the bottom wall of the pourer.

The interior of the body of the pourer is provided with an annular inwardly extending projection 10 which engages, in use, with a corresponding recess 12 in a bung 14 (see FIG. 2) which can be snapped into the upper portion of the pourer and provide a tight fit to prevent liquid passing through the outlet 2 from being dispensed through the pourer.

Figure 2:
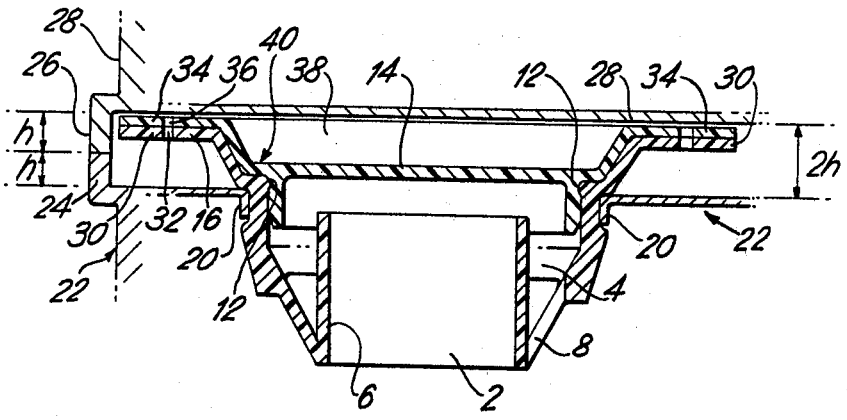
FIG. 2 is a cross-section of the pouring device with the bung inserted and showing it fitted into a first container with a second container stacked upon the first container.
Figure 3:
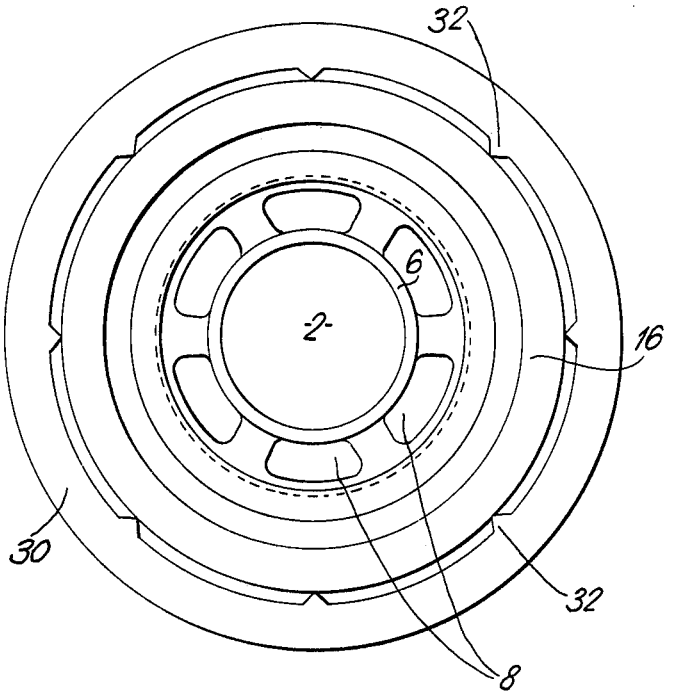
FIG. 3 is a plan view corresponding to FIG. 1 but showing a break-away ring portion.

The pourer has an outwardly extending annular lip 16 to aid pouring and is provided with a recess 18 in its side wall to receive the down-turned lip 20 of the edge of a hole in the upper surface of a liquid container generally indicated at 22 (see FIG. 2). The hole in the upper container wall into which the pourer is inserted, is positioned adjacent the side wall of the container and the arrangement is such that the pouring lip of the pourer is located above the upper wall of the container and extends to a position closely adjacent the upper face of a chime 24 which extends upwardly from the side wall of the container. The height *h* of the chime 24 is made approximately half the height by which the upper face of the bung extends above the surface of the container. The chime 26 on the bottom of a similar container 28 has the same dimension *h* so that when a second or upper container 26 is stacked upon the first or lower container the pouring device is contained within the space between the two containers and does not impair the stability of the two stacked containers.

Prior to use the bung 14 is sealed to the body of the pourer by a break-away ring comprising a lower portion 30 which is attached by means of spokes 32 to the outer edge of the pouring lip and an upper part 34 which is welded to the lower part 30 and is connected to the outer periphery of the bung by means of spokes 36.

When the pourer is to be used the portion 30 is broken away from the edge of the pouring lip 16 so that the bung may be removed. Subsequently both portions of the ring are broken away from the bung leaving the bung free for re-use.

The bung is provided with an outwardly extending tab (not shown) which does not form part of the break-away ring but extends over the lower portion of the ring without being welded thereto. This tab subsequently provides a handle to enable the bung readily to be removed from the pourer.

During use it will be appreciated that if the container to which the pourer is fitted (and normally the pourer will be in a corner of the container if this is rectangular) is tilted to the left as shown in the drawings the orifices 8 on the left hand side act as additional liquid outlets enabling liquids to flow along paths indicated by the arrows 40 and 42 of FIG. 1. At the same time air can flow into the container via paths 44 at the right hand side of the pourer.

Referring to FIG. 2 it will be seen that the upper face of the bung is provided with a dished upper surface 38 which extends over the projection 12 so that when the assembled pourer and bung are inserted into the contianer pressure can be applied by a mandrel or the like in the region indicated at 40 to aid in the assembly of the pourer to the container.

The bung and pouring device are conveniently made of a low density polyethylene or else any convenient plastics material such as plasticised PVC can be used. It will be appreciated that due to the symmetrical construction of the pouring device about its central axis the assembly of the pouring device into the container can be such that provided axial alignment is maintained, radial alignment is not required.

We claim:

1. A pouring device adapted to be fixed to an upper surface of a container, said device comprising a central pouring tube mounted within a body of said device, said body having a substantially cylindrical wall in which there if provided an outer peripheral container engaging groove and air inlet structure positioned around said tube between said tube and wall, said body being extended outwardly and conically from an area adjacent said groove in a widely flared manner away from said pouring tube to a thin planar annulus forming a pouring lip whose plane is higher with respect to said groove than the outer extremity of said central pouring tube, and a bung fitted in said device, said bung having an interior and exterior surface approximately conforming to the interior shape of said body of said device from an area adjacent said engaging groove outwardly along said conical extension and at least covering a part of said annular pouring lip, said bung having a sealing surface below said annular pouring lip, said bung being fixed to said pouring lip around an annular outer extremity of said pouring lip, and said annular outer extremity being perforated to provide a break away ring.

2. A container with the pouring device of claim 1 fitted in the top wall thereof and in a position adjacent the side wall thereof, said side wall having an upstanding chime which is half the height by which the pourer extends from the top wall, said side wall having a downwardly projecting chime extending from the bottom wall which is similarly dimensioned to the upstanding chime.

3. A container as claimed in claim 2 where said pouring lip extends at least as far as said upstanding chime.

4. A pouring device comprising a container with a side wall having an upstanding chime extending upward from a top wall and having a downwardly projecting chime extending downward from a bottom wall, said downwardly projecting chime being similarly dimensioned to said upstanding chime relative to the height thereof, a central pouring tube mounted within a body, said body having substantially cylindrical wall in which there is provided an outer peripheral container engaging groove and air inlet structure positioned around said tube between said tube and wall, said body extending outwardly conically from an area adjacent said groove to a thin planar annulus forming a pouring lip, an annular rim being provided in said area adjacent said groove at the root of the conical extension on the interior of said body, said body being fitted in the top wall of said container in a position adjacent the side wall thereof, said body extending above said top wall a distance no greater than twice the height of said upstanding chime, and a bung sealing said device, said bung having an interior and exterior surface approximately conforming to the interior shape of said body of said device from said annular rim outwardly along said conical extension and at least covering a part of said annular pouring lip, said bung having a sealing surface below said annular rim so that part of said bung coinciding with said annular rim forms a surface which can be engaged by a mandrel to securely force said bung into a hole in the container so that said engaging groove seats in said hole, said bung being fixed to said pouring lip around an annular outer extremtiy of said pouring lip, and said annular outer extremity being perforated to provide a break away ring.

5. A container as claimed in claim 4 wherein said pouring lip extends at least as far as said upstanding chime.

* * * * *